United States Patent [19]

Gilmour

[11] 4,158,266

[45] Jun. 19, 1979

[54] SHOCK ABSORBENT DISPLAY MOUNTING APPARATUS AND METHOD

[76] Inventor: Richard L. Gilmour, P.O. Box 154, Boulder Creek, Calif. 95006

[21] Appl. No.: 736,876

[22] Filed: Oct. 29, 1976

[51] Int. Cl.[2] ..... G09F 1/12

[52] U.S. Cl. ..... 40/152; 206/591

[58] Field of Search ..... 40/152, 152.1, 156, 40/10; 428/14; 206/591, 592

[56] References Cited

U.S. PATENT DOCUMENTS

| | | | |
|---|---|---|---|
| 1,002,910 | 9/1911 | Foote | 40/160 X |
| 1,649,415 | 11/1927 | Moseson | 40/152 |
| 1,662,744 | 3/1928 | Hardee | 206/591 |
| 2,811,799 | 11/1957 | Clark | 40/152 |
| 2,860,768 | 11/1958 | Smithers | 206/591 |
| 2,874,826 | 2/1959 | Mathews et al. | 206/591 |
| 3,430,829 | 3/1969 | Wilson et al. | 40/1.5 X |
| 3,611,604 | 10/1971 | Saltzman | 40/152 |
| 3,751,838 | 8/1973 | Wiener | 40/156 |

*Primary Examiner*—Louis G. Mancene
*Assistant Examiner*—Wenceslao J. Contreras
*Attorney, Agent, or Firm*—Flehr, Hohbach, Test, Albritton & Herbert

[57] ABSTRACT

A frame having a transparent front plate retained therein, against which is placed an article for viewing through the transparent front plate. A resilient member is placed within the confines of the frame and a back plate is brought to bear against the rear side of the resilient member and structurally retained in position to compress the resilient member, thereby forcing it against the transparent front plate and the article placed adjacent thereto. The method includes aligning the frame with the transparent front plate on a grid, and subsequently orienting the article on the inside of the transparent front plate relative to the grid. The article is thereafter forced against the transparent front plate with a yieldable force applied thereacross, which is maintained after removal of the frame from the grid.

12 Claims, 10 Drawing Figures

SHOCK ABSORBENT DISPLAY MOUNTING APPARATUS AND METHOD

BACKGROUND OF THE INVENTION

This invention relates to a mounting frame and method for articles to be displayed and more particularly to such frame and method for obtaining table and wall mounted displays for relatively fragile articles.

It has been the practice in the past to provide a framework with a transparent front plate retained therein in which an article to be displayed is mounted in spaced relation behind the transparent front plate. A mounting plate for retention within the frame is disposed a distance behind the transparent front plate and the article for display is mounted thereon by means of some adhesive, or mechanical fastening device. The mounting plate is generally retained within the frame by means of brads or the like driven into the frame behind the mounting plate after it is placed therein. There is a considerable amount of time and highly skilled labor required to mount the article on the mounting plate, particularly when the article is a fragile item such as a butterfly specimen. In the latter instance the specimen on display is for the most part structurally unsupported in the space between the transparent front plate and the mounting plate. Consequently, it is susceptible to damage from shock imposed on the frame as the structural portions of the specimen experience the transmitted shock imposed force load. Shipping and transportion of these old art type displays is impractical due to the probability of damage en route. Damage is also incurred through normal handling without regard to the rigors of shipping and transportation. A mounting assembly and method for displays is desirable which requires minimum time in assembly and minimally skilled labor to assemble, and which will withstand the mistreatment normally experienced during shipping and transportation without damage.

OBJECTS AND SUMMARY OF THE INVENTION

A mounting assembly is disclosed for holding an article to be placed on display and includes a closed frame having a transparent front plate retained therein. A back plate is provided together with means for retaining the back plate within the frame. A resilient body member is contained within the frame and retained in compression between the transparent front plate and the back plate. Thus, when an article to be displayed is placed between the resilient body member and the transparent front plate it may be viewed therethrough and held firmly thereagainst by the compressive force exerted against the resilient body member. The method includes aligning a frame having a transparent plate on a grid with the transparent front plate adjacent to the grid. Thereafter the article to be displayed is placed against the interior surface of the front plate and oriented in predetermined fashion relative to the grid. A force is exerted across the internal surface of the front plate and against the article and the force is maintained thereagainst after the frame is removed from the grid. In this fashion a delicate article is mounted in an attractive display so as to reduce susceptibility of the article to damage from shock loads imposed on the frame.

In general, it is an object of the present invention to provide an apparatus and method for forming framed displays which protects the displayed article from damage during shipment and normal handling.

Another object of the invention is to provide an apparatus and method for forming framed displays which requires less labor, effort and less skilled labor during assembly.

Another object of the invention is to provide an apparatus and method for forming framed displays which provides an attractive display and stabilizes the displayed article.

Another object of the invention is to provide an apparatus and method for forming framed displays which may be exhibited in hanging or standing fashion as desired.

Additional objects and features of the invention will appear from the following description in which the preferred embodiments have been set forth in detail in conjunction with the accompanying drawings.

DESCRIPTION OF THE PREFERRED EMBODIMENTS

Figure 1:
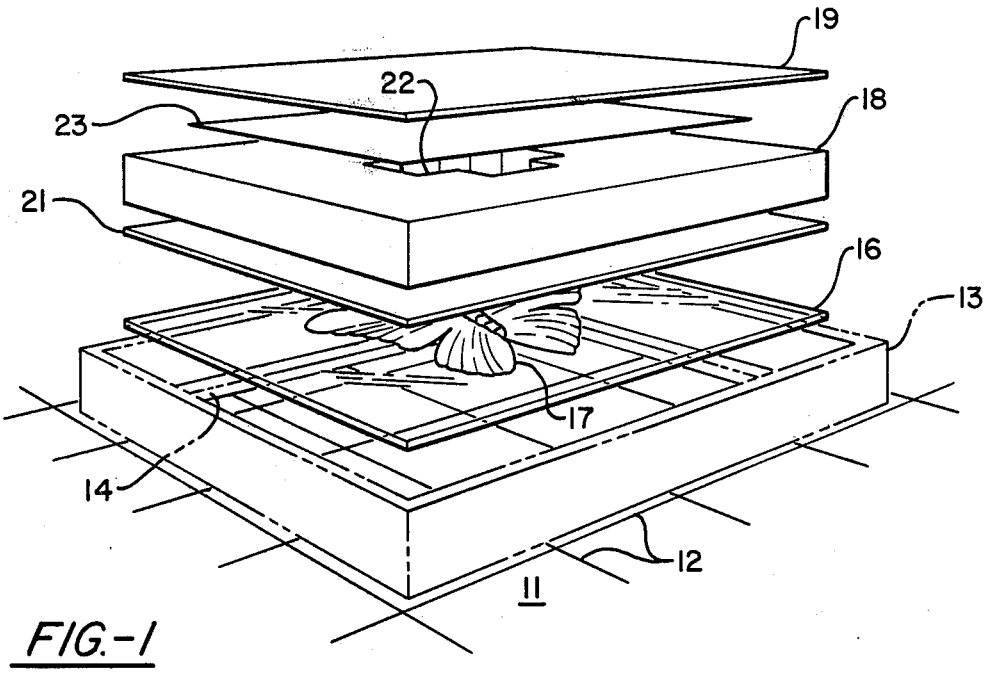
FIG. 1 is an isometric exploded view of the display assembly.

FIG. 1 shows a surface 11 on which is marked a grid 12. When assembling the display a frame 13 is aligned on the grid 12. The frame 13 has a front lip 14 which supports and retains a transparent front plate 16. An article 17 to be displayed is represented in FIG. 1 by a butterfly which is placed on the internal surface of transparent front plate 16 as shown and oriented relative to grid 12. A resilient body member 18 is placed on top of or behind the displayed article 17 and a back plate 19 is positioned overlying resilient body member 18. The spacing between transparent front plate 16 and back plate 19 is such as to compress the thickness of resilient body member 18 to thereby exert a force across the internal face of transparent front plate 16 and the rear side of displayed article 17 exposed thereto.

In this fashion the displayed article 17, the butterfly in FIG. 1, is held firmly against the transparent front plate 16 when back plate 19 is retained in place. Shock loads imposed on frame 13 are thereby reduced in transmission through resilient body member 18 to the displayed article 17. Displayed article 17 is thereby partially isolated from detrimental forces arising therefrom.

FIG. 1 also shows a thin resilient sheet 21 which may be inserted between transparent front plate 16 and resilient body member 18 behind the displayed article 17.

Thin resilient sheet 21 may be colored to provide a desired background hue for displayed article 17. Resilient body member 18 may have a cavity 22 therein which may or may not extend therethrough. Cavity 22 is provided in the event displayed article 17 has considerable thickness. In such case the compression of resilient body member 18 between displayed article 17 and back plate 19 might impart damaging force to displayed article 17. Cavity 22 removes this danger. Moreover, thin resilient sheet 21 overlies cavity 22 and masks it from the field of view through transparent front plate 16.

FIG. 1 also shows a sheet-like member 23 disposed between back plate 19 and the rear side of resilient body member 18. Sheet-like member 23 has a relatively smooth surface and serves to provide a low friction surface on which back plate 19 may slide during assembly. In some instances when back plate 19 is placed in the assembly such that it moves laterally relative to resilient body member 18 as hereinafter described, the friction between resilient body member 18 and back plate 19 may be at a high enough level to make assembly of back plate 19 difficult. Insertion of sheet-like member 23 overlying the rear surface of resilient body member 18 removes this difficulty.

Figure 2:
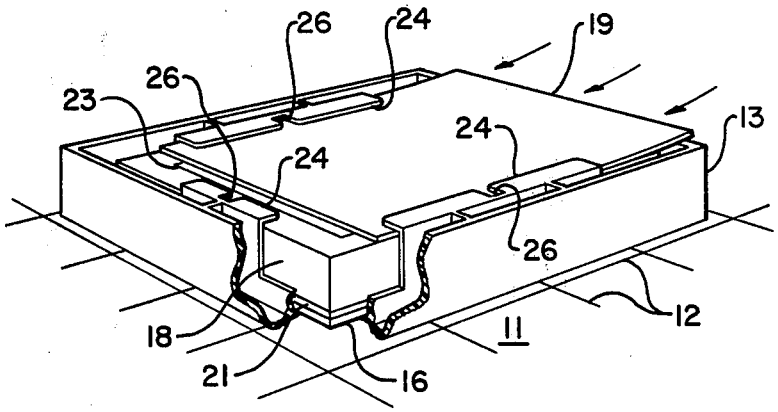
FIG. 2 is an isometric view of one embodiment of the display assembly.

FIG. 2 shows one embodiment of the assembly of FIG. 1 wherein the frame 13 is a molded plastic member. This display assembly is constructed as described for FIG. 1 above utilizing grid 12 on surface 11. Frame 13 has front lip 14 shown with transparent front plate 16 resting thereon within the confines of frame 13. Thin resilient sheet 21 may or may not be included in the assembly as desired. A mat (not shown) may be disposed about the periphery of the displayed article 17 in place of thin resilient sheet 21, or such a mat may be inserted between transparent front plate 16 and thin resilient sheet 21. Frame 13 in FIG. 2 is seen to have four sides with inwardly extending tabs 24 at the rear edges of three of the four sides. Each of the inwardly extending tabs 24 has a centrally located notch 26 therein. Back plate 19 has a width which is greater than the spacing between the tabs 24 on opposing sides of frame 13. Consequently when back plate 19 is inserted over one edge of frame 13 as shown by the arrows in FIG. 2, it is passed underneath inwardly extending tabs 24 on opposing sides of frame 13 to be retained thereunder within frame 13. One end of back plate 19 is placed beneath tab 24 on the crossing member of frame 13 to further retain back plate 19. Consequently, when resilient body member 18 has a thickness which is greater than the spacing between transparent front plate 16 and the position of back plate 19 as determined by inwardly extending tabs 24, resilient body member 18 is compressed in the display assembly. The compression produces a force or pressure which is exerted across the entire inside surface of transparent front plate 16 forcing the displayed article 17 thereagainst.

Figure 3:
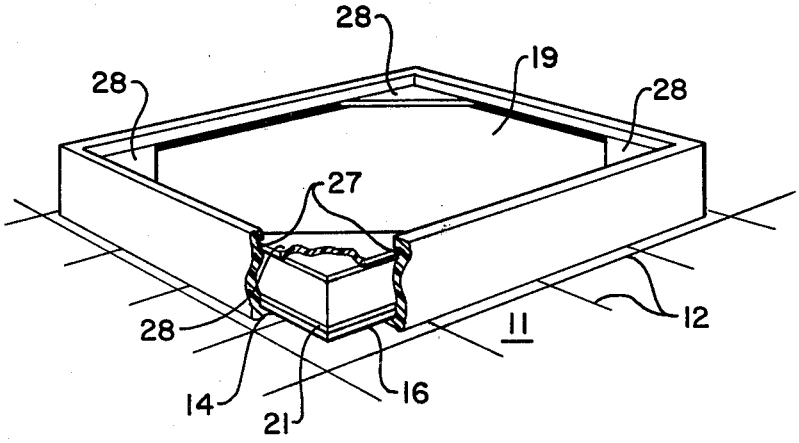
FIG. 3 is an isometric view of another embodiment of the display assembly.

FIG. 3 shows an alternate embodiment of the mounting assembly having different means therein for retaining back plate 19 within frame 13. Frame 13 is shown having four sides with grooves 27 formed on the inwardly facing surfaces spaced from the back edges thereof. Grooves 27 in the four sides of frame 13 are seen to intersect at the corners thereof forming a continuous peripheral groove. Back plate 19 in this embodiment has a length and width which are smaller than the length and width of the opening through the back of frame 13. Frame 13 has a front lip 14 thereon as means for retaining transparent front plate 16 within frame 13. When desired a mat (not shown) and/or the thin resilient sheet 21 is disposed behind the displayed article 17 (not seen in FIG. 3). Resilient body member 18 is provided having a thickness greater than the spacing between transparent front plate 16 and grooves 27. When back plate 19 is placed within the rear opening in frame 13 the pressure exerted against back plate 19 will compress and diminish the thickness of resilient body member 18 thereby making grooves 27 accessible. A plurality of tabs 28 are provided having a thickness such that they are received within grooves 27. As seen in FIG. 3 tabs 28 are triangular in shape and one each is inserted into portions of peripheral groove 27 at the inside of the corners of frame 13 thereby retaining back plate 19 in place and resilient body member 18 in compression. Tabs 28 may be of alternate shapes and may engage peripheral groove 27 at other portions thereof.

Figure 4:
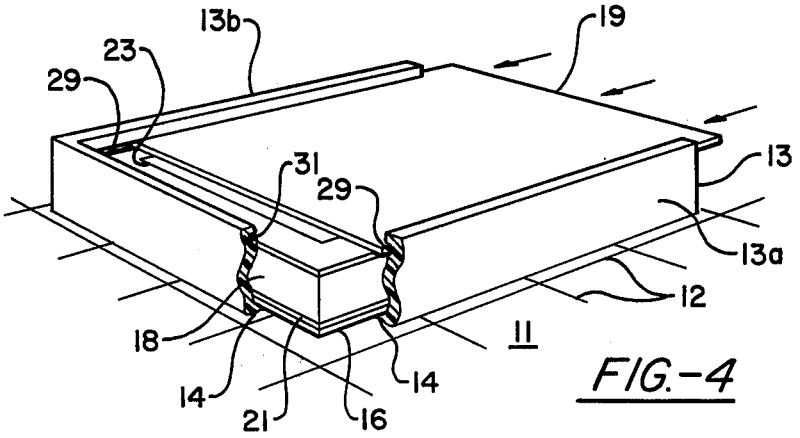
FIG. 4 is an isometric view of yet another embodiment of the display assembly.

FIG. 4 shows yet another alternative method for retaining back plate 19 within frame 13. Like item numbers described heretofore refer to like items. Back plate 19 has a width dimension in FIG. 4 which is greater than the width of the opening through the rear of frame 13. Inwardly facing grooves 29 are formed on opposing sides 13*a* and 13*b* of frame 13 which are spaced from the rear edges thereof. One side of frame 13 extending between opposing sides 13*a* and 13*b* has a rear edge which is spaced from grooves 29 so that the ends of grooves 29 are accessible. Grooves 29 have a width to accept the thickness of back plate 19 thereby forming means for retaining back plate 19 within frame 13. When resilient body member 18 in the assembly of FIG. 4 is compressed so that the surface thereof is spaced from the rear edges of frame 13 exposing grooves 29, back plate 19 is inserted into grooves 29 from the ends thereof to thereby retain resilient body member 18 within the confines of frame 13 in a compressed condition. The other end of frame 13 extending between opposing sides 13*a* and 13*b* may also contain a groove 31 spaced from the rear edge thereof and intersecting grooves 29. Groove 31 is formed to accept the thickness of the end of back plate 19 when it is inserted completely within grooves 29. FIG. 4 also shows sheet-like member 23 disposed between the back side of resilient body member 18 and back plate 19 to reduce friction therebetween when back plate 19 is slid into grooves 29.

Figure 5:
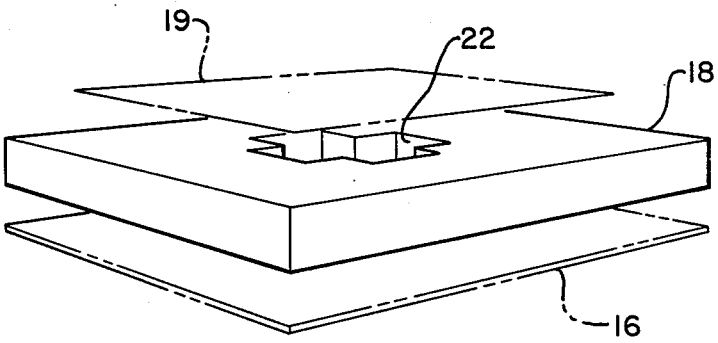
FIG. 5 is an isometric view of one configuration of the resilient body member in the display assembly.

FIG. 5 shows resilient body member 18 having cavity 22 therein. As mentioned heretofore, cavity 22 may be shaped to accept the displayed article 17 or it may extend completely through resilient body member 18, depending upon the application. The exploded view of FIG. 5 shows back plate 19 and transparent front plate 16 in ghost line position prior to compressing resilient body member 18 therebetween. The compression imposed on resilient body member 18 serves to provide a force or pressure at the inside surface of transparent front plate 16 which firmly fixes displayed article 17 in position thereagainst.

Figure 6:
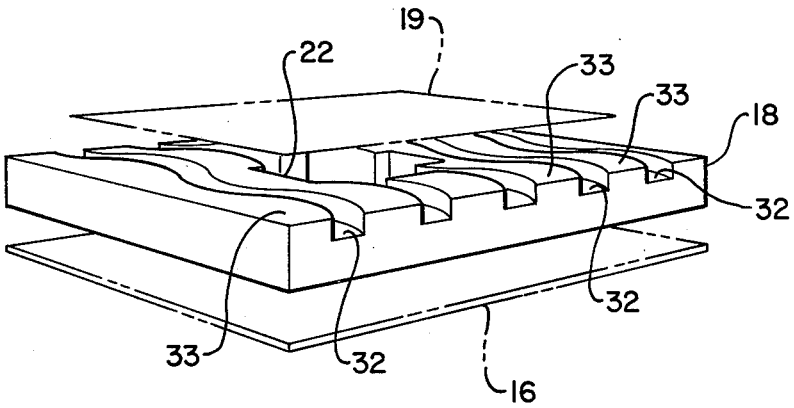
FIG. 6 is another configuration of the resilient body member in the display assembly.

FIG. 6 shows an alternate embodiment of resilient body member 18 wherein grooves 32 and lands 33 are formed on the rear side thereof. Material removed from the rear side of resilient body member 18 formerly occupying the grooves 32 therein allows resilient body member 18 to be compressed with lesser applied force between back plate 19 and transparent front plate 16. This embodiment is useful for those applications where the force to be exerted against the displayed article 17 located between resilient body member 18 and the inside surface of transparent front plate 16 must be kept at a relatively low level.

Figure 7:
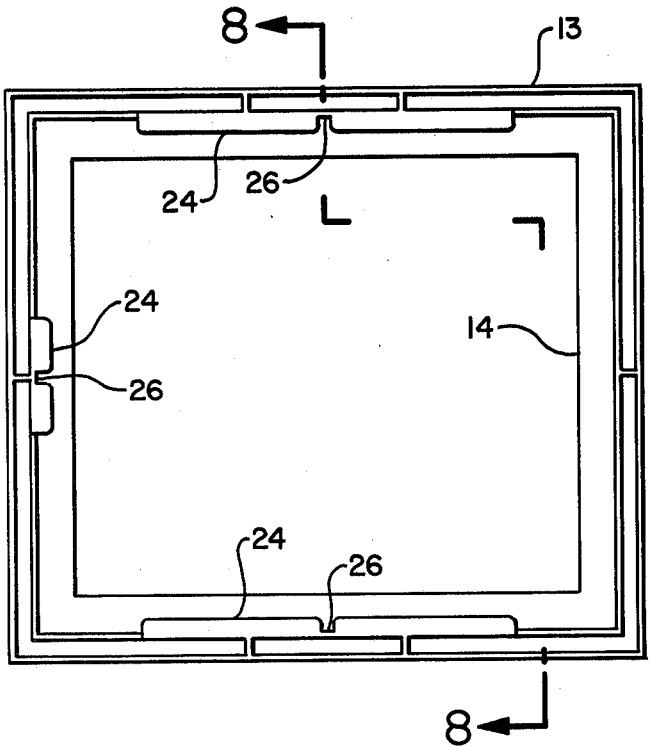
FIG. 7 is a planar view of one type of frame used in the display assembly.

Turning now to FIG. 7 a specific frame 13 is seen which may be formed of molded plastic. Front lip 14 is seen thereon together with inwardly extending tabs 24 on three sides thereof and centrally located notches 26. It may be seen that subsequent to assembly of the mounting display the assembly may be hung on a protrusion such as a peg extending from a wall for example, by placing any one of notches 26 over the protrusion. In this fashion frame 13 may be supported on the wall in any one of three different orientations. The fourth side of the frame 13 in FIG. 7 is free of tabs 24. That side is the side over which back plate 19 is passed to lie underneath tabs 24 on the remaining three sides when assembling the display assembly.

Figure 8:
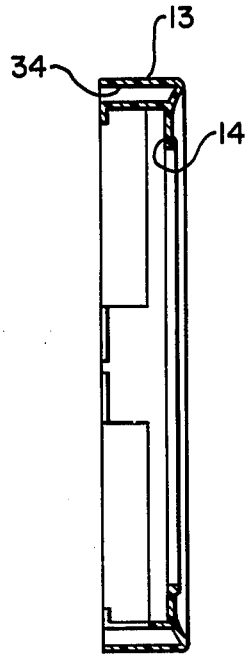
FIG. 8 is a sectional view taken along the line 8—8 of FIG. 7.

FIG. 8 shows the sides of frame 13 to have a cavity 34 therein for lightening the frame. In this fashion the load required to be carried by the protrusions supporting the frame 13 in notches 26 is decreased.

Figure 9:
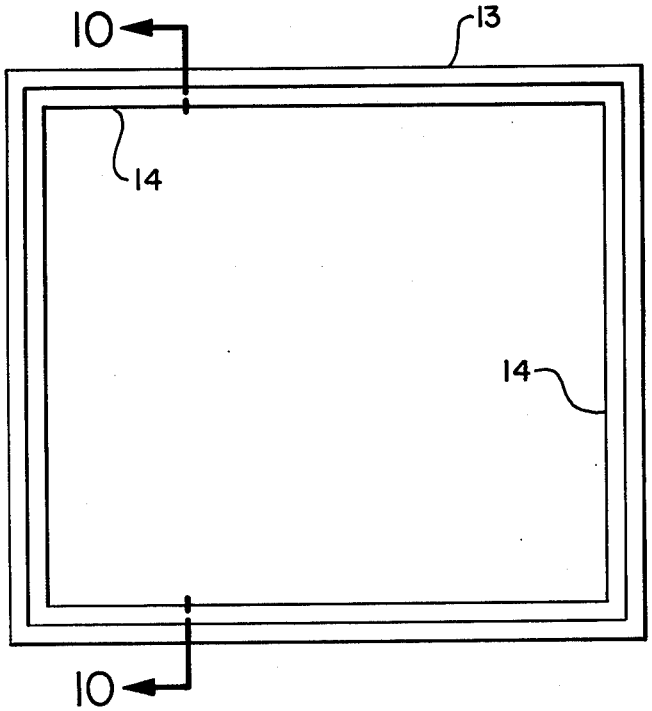
FIG. 9 is a planar view of another type of frame used in the display assembly.

Turning now to FIG. 9 a frame 13 is shown which may be fabricated of wood. The frame 13 of FIG. 9 also has a front lip 14 thereon for supporting and retaining transparent front plate 16.

Figure 10:
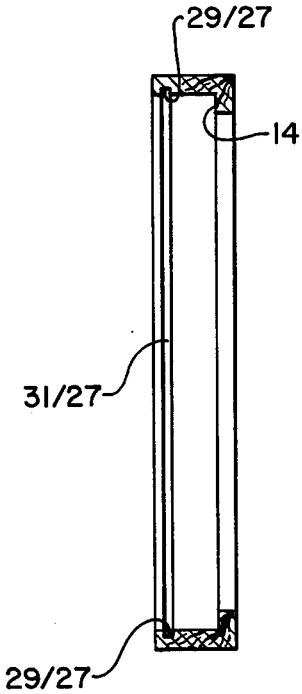
FIG. 10 is a sectional view along the line 10—10 of FIG. 9.

FIG. 10 shows inwardly facing grooves on the inner surfaces of frame 13 spaced from the back edge thereof. These grooves may either be the peripheral groove 27 of FIG. 3 or the opposing grooves 29 and end groove 31 of FIG. 4. In the embodiment of FIGS. 9 and 10 resilient body member 18 is compressed between transparent front plate 16 resting on front lip 14 and back plate 19 retained in place on the other side of resilient body member 18 by grooves 29 and 31 or by tabs 28 placed within grooves 27 to retain back plate 19 therebeneath.

It is seen from the foregoing that a display assembly has been described together with a method for forming a display which requires unskilled labor compared to that required for known displays. Furthermore the assembly and method disclosed herein requires relatively little time to assemble or perform as compared to known displays and methods. Normal handling of delicate displayed articles is possible without imparting damaging forces to the displayed article through shock imposed thereon during assembly. Shipment and transportion of the displayed articles may be made within the disclosed display assembly without danger of damage to delicate displayed articles from the considerable shocks imposed on the display frame during such shipment and transportion. Handling of delicate displayed articles is thus considerably reduced and the articles are early placed in an environment experiencing reduced forces from shock loads. Thus, the two greatest sources of damage to delicate displayed articles, transportation handling and initial unmounted handling, are rendered relatively innocuous.

What is claimed is:

1. A mounting assembly for holding an article to be displayed, comprising a frame, a transparent front plate, a back plate, means for retaining said back plate within said frame, a front lip on said frame disposed to retain said front plate therein, a resilient body within said frame retained in compression between said front and back plates, said resilient body having a cavity therein adapted to receive the article to be displayed, and a resilient sheet between said transparent front plate and said resilient body overlying said cavity, whereby the article to be displayed when placed between said resilient body and said transparent front plate is viewed therethrough and held firmly thereagainst by compressive force exerted against said resilient body and resilient sheet.

2. A mounting assembly as in claim 1 together with a mat disposed about the periphery of the article to be displayed and between said transparent front plate and resilient body.

3. A mounting assembly as in claim 1 wherein said frame comprises four sides and said means for retaining said back plate comprises inwardly projecting tabs on three of said four sides.

4. A mounting assembly as in claim 1 wherein said frame comprises four sides and said means for retaining said back plate comprises a plurality of separate tab members, said four sides having longitudinal intersecting grooves spaced from the back edges thereof formed to accept said tabs, whereby when the edges of said plurality of tabs are inserted in said grooves, said back plate is held within said frame against the compressive force.

5. A mounting assembly as in claim 1 wherein said frame is a rectangle, two parallel sides of said rectangle having longitudinal facing grooves therein comprising said means for retaining, said longitudinal facing grooves being spaced from the back edges of said two parallel sides and formed to accept opposing edges of said back plate, another one of said four sides having a back edge disposed so that said longitudinal facing grooves are accessible from the ends thereof.

6. A mounting assembly as in claim 1 together with a sheet member disposed between said resilient body and said back plate, said sheet member providing a lower friction level with said back plate than the friction level between said back plate and resilient body, so that said back plate is more freely moved laterally relative to said resilient body.

7. A mounting assembly according to claim 1 wherein said resilient body has material removed from the back side thereof so that the compressive force required to retain said resilient body between said front and back plates is decreased.

8. A mounting display comprising a frame having a plurality of sides and front and back faces, a transparent front plate, a front lip on said frame retaining said transparent front plate therein, inwardly projecting tabs on the back faces of opposing sides of said frame, a back plate extending between said opposing sides and retained within said frame by said inwardly projecting tabs, a resilient member extending between the sides of said frame and retained in compression between said back plate and said transparent front plate, and a relatively smooth planar sheet disposed between said resilient member and said back plate, said planar sheet being constructed so as to reduce friction forces on said back plate and so as to facilitate lateral motion of said back plate during assembly, whereby an article placed between said resilient member and said transparent front plate is viewed therethrough and retained within said frame with reduced susceptibility to shock induced forces.

9. A mounting display as in claim 8 wherein said resilient member has a cavity therein adapted to accommodate the article, together with a resilient sheet disposed between said resilient member and said transparent front plate overlying the cavity behind the article.

10. A mounting assembly for holding an article to be displayed, comprising a frame, a transparent front plate, a back plate, a resilient body located between said transparent front plate and said back plate, said article being located between said transparent front plate and said resilient body, and means for maintaining said resilient body in a state of compression between said front and back plates, whereby said body continuously applies force against said article, said resilient body being constructed so that it applies less force to at least a segment of said article than to said transparent front plate.

11. A mounting assembly as in claim 10 wherein said resilient body includes a cavity therein whereby to provide said less force.

12. A mounting assembly for holding an article to be displayed, comprising a frame, transparent front plate, a back plate, means for retaining said back plate within said frame, a front lip on said frame disposed to retain said front plate therein, a resilient body within said frame retained in compression between said front and back plates, said resilient body having material removed from the back side thereof forming lands thereon, said material being removed in sufficient amounts to decrease the compressive force required to retain said resilient body between said front and back plates and a sheet member disposed between said resilient body and said back plate, said sheet member providing a lower friction level with said back plate than the friction level between said back plate and resilient body, so that said back plate is more freely moved laterally relative to said resilient body.

* * * * *